US012698636B2

(12) United States Patent
Mitchell et al.

(10) Patent No.: US 12,698,636 B2
(45) Date of Patent: Aug. 4, 2026

(54) BATTERY PACK POWERED TROWEL INCLUDING BLADE PITCH AND SPEED CONTROL

(71) Applicant: MILWAUKEE ELECTRIC TOOL CORPORATION, Brookfield, WI (US)

(72) Inventors: Garrett P. Mitchell, Milwaukee, WI (US); Evan M. Glanzer, Milwaukee, WI (US); Ian C. Richards, Milwaukee, WI (US); Dominick Ropella, New Berlin, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 614 days.

(21) Appl. No.: 18/310,879

(22) Filed: May 2, 2023

(65) Prior Publication Data

US 2023/0366219 A1 Nov. 16, 2023

Related U.S. Application Data

(60) Provisional application No. 63/340,677, filed on May 11, 2022.

(51) Int. Cl.
*E04F 21/24* (2006.01)

(52) U.S. Cl.
CPC ..... *E04F 21/248* (2013.01)

(58) Field of Classification Search
USPC ..... 404/112
See application file for complete search history.

(56) References Cited

U.S. PATENT DOCUMENTS

| | | | | |
|---|---|---|---|---|
| 2,875,676 | A | 3/1959 | Thieme et al. | |
| 2,979,996 | A | 4/1961 | Spitler et al. | |
| 3,331,290 | A | 7/1967 | Harding, Jr. | |
| 4,232,980 | A | 11/1980 | Tertinek et al. | |
| 4,629,359 | A | 12/1986 | Sengupta | |
| 5,372,452 | A | 12/1994 | Hodgson | |
| 5,405,216 | A * | 4/1995 | Allen | E04F 21/248 404/112 |
| 5,632,570 | A | 5/1997 | Balling | |
| 5,803,657 | A | 9/1998 | Hodgson | |
| 6,846,127 | B1 | 1/2005 | Braun et al. | |
| 6,883,999 | B1 | 4/2005 | Jenkins et al. | |

(Continued)

FOREIGN PATENT DOCUMENTS

| | | | |
|---|---|---|---|
| CN | 109025220 | A | 12/2018 |
| CN | 209703963 | U | 11/2019 |

(Continued)

*Primary Examiner* — Gary S Hartmann
(74) *Attorney, Agent, or Firm* — Michael Best & Friedrich LLP

(57) ABSTRACT

A power trowel that includes a handle, a housing, a blade assembly including a trowel blade, a motor coupled to the blade assembly, a plurality of sensors configured to generate output signals related to an operational state of the power trowel, and a controller connected to the motor and the plurality of sensors. The controller is configured to receive the output signals from the plurality of sensors, determine, based on the output signals, a speed setting for the blade assembly and a pitch angle for the trowel blade, and control the motor to drive the blade assembly at the speed setting with the trowel blade at the pitch angle.

16 Claims, 8 Drawing Sheets

(56) References Cited

U.S. PATENT DOCUMENTS

| | | | | |
|---|---|---|---|---|
| 7,004,676 | B2 * | 2/2006 | Williams | E04F 21/245 404/112 |
| 7,065,837 | B2 | 6/2006 | Kruepke | |
| 7,381,009 | B2 | 6/2008 | Jenkins et al. | |
| 10,968,574 | B2 | 4/2021 | Mikowychok | |
| 11,927,022 | B2 * | 3/2024 | Richards | E04F 21/248 |
| 12,163,341 | B2 * | 12/2024 | Reed | E04F 21/248 |
| 12,241,266 | B2 * | 3/2025 | Richards | E04F 21/248 |
| 2002/0150426 | A1 | 10/2002 | Vandewinckel et al. | |
| 2007/0006840 | A1 | 1/2007 | Hedlund | |
| 2008/0289842 | A1 | 11/2008 | Chapple et al. | |
| 2010/0150653 | A1 * | 6/2010 | Jaszkowiak | E04F 21/247 404/112 |
| 2011/0268504 | A1 | 11/2011 | Marx et al. | |
| 2021/0143709 | A1 | 5/2021 | Sprague et al. | |
| 2023/0250651 | A1 * | 8/2023 | Esh | F16H 1/2854 404/112 |

FOREIGN PATENT DOCUMENTS

| | | | | |
|---|---|---|---|---|
| CN | 110578398 | A | 12/2019 | |
| CN | 110670453 | A | 1/2020 | |
| CN | 110670454 | A | 1/2020 | |
| CN | 110820484 | A | 2/2020 | |
| CN | 210946404 | U | 7/2020 | |
| CN | 211037857 | U | 7/2020 | |
| CN | 211079838 | U | 7/2020 | |
| CN | 211278916 | U | 8/2020 | |
| EP | 1435420 | A2 * | 7/2004 | E04F 21/248 |
| EP | 2789766 | A1 | 10/2014 | |
| WO | 2021158690 | A9 | 4/2022 | |

* cited by examiner

BATTERY PACK POWERED TROWEL INCLUDING BLADE PITCH AND SPEED CONTROL

RELATED APPLICATIONS

This application claims the benefit of U.S. Provisional Patent Application No. 63/340,677, filed May 11, 2022, the entire content of which is hereby incorporated by reference.

SUMMARY

Conventional trowels require a user to manually adjust the speed and the pitch of blades of the power trowel based, for example, only on feel and approximate state-of-cure of the concrete.

Embodiments described herein provide systems and methods for automatically controlling blade rotational speed and blade pitch of a power trowel. The power trowel can detect the conditions of the concrete and automatically set the speed and pitch of the blades to achieve the optimal results. This could allow for less-skilled operators to use the machines and it could provide more consistent results among different users. The power trowel sets the speed and the pitch based on, for example, load sensing and measured conditions of concrete.

Power trowels described herein include a handle, a housing, a blade assembly including a trowel blade, a motor coupled to the blade assembly, a plurality of sensors configured to generate output signals related to an operational state of the power trowel, and a controller connected to the motor and the plurality of sensors. The controller is configured to receive the output signals from the plurality of sensors, determine, based on the output signals, a speed setting for the blade assembly and a pitch angle for the trowel blade, and control the motor to drive the blade assembly at the speed setting with the trowel blade at the pitch angle.

In some aspects, the plurality of sensors include a load sensor configured to provide a load signal indicative of a load condition of the motor.

In some aspects, the controller is further configured to monitor the load condition of the motor, and adjust at least one of the speed setting and the pitch angle based on the load condition of the motor.

In some aspects, the load condition is at least one selected from a group consisting of: a current draw of the motor, a power draw of the motor, a rotations-per-minute ("RPM") of the motor, and an RPM of the blade assembly.

In some aspects, the plurality of sensors include a motion sensor configured to provide a motion signal indicative of a motion of the power trowel.

In some aspects, the controller is further configured to monitor the motion of the power trowel, and adjust at least one of the speed setting and the pitch angle based on the motion of the power trowel.

In some aspects, the power trowel further includes a machine learning controller configured to determine, based on the output signals, the speed setting for the blade assembly and the pitch angle for the trowel blade.

In some aspects, the plurality of sensors include at least one of an electromagnetic wave/radar sensor, an ultrasonic sensor, and concrete penetrometer, and the controller is further configured to determine a parameter of a surface based on the output signals from the plurality of sensors.

Methods of controlling a power trowel described herein include receiving, from a plurality of sensors, output signals related to an operational state of the power trowel, determining, using an electronic controller, a speed setting for a blade assembly and a pitch angle for a trowel blade based on the output signals related to the operational state of the power trowel, and controlling a motor to drive the blade assembly at the speed setting with the trowel blade at the pitch angle.

In some aspects, the plurality of sensors include a load sensor providing a load signal indicative of a load condition of the motor.

In some aspects, the method further includes monitoring the load condition of the motor, and adjusting at least one of the speed setting and the pitch angle based on the load condition of the motor.

In some aspects, the load condition is at least one selected from a group consisting of: a current draw of the motor, a power draw of the motor, a rotations-per-minute ("RPM") of the motor, and an RPM of the blade assembly.

In some aspects, the plurality of sensors include a motion sensor providing a motion signal indicative of a motion of the power trowel.

In some aspects, the method further includes monitoring the motion of the power trowel, and adjusting at least one of the speed setting and the pitch angle based on the motion of the power trowel.

In some aspects, the method further includes determining, using a machine learning controller and based on the output signals, the speed setting for the blade assembly and the pitch angle for the trowel blade.

In some aspects, the plurality of sensors include at least one of an electromagnetic wave/radar sensor, an ultrasonic sensor, and concrete penetrometer, and the method further includes determining a parameter of a surface based on the output signals from the plurality of sensors.

Power trowels described herein include a handle, a housing, a blade assembly including a trowel blade, a motor coupled to the blade assembly, a surface sensor configured to provide an output signal indicative of a parameter of a surface, and a controller connected to the motor and the surface sensor. The controller is configured to receive the output signal from the surface sensor, determine, based on the output signal, whether the parameter of the surface corresponds to a shutdown condition, and deactivate the motor in response to the parameter of the surface corresponding to the shutdown condition.

In some aspects, the power trowel further includes a plurality of sensors configured to generate a plurality of output signals related to an operational state of the power trowel.

In some aspects, the controller is further configured to determine, based on the plurality of output signals, a speed setting for the blade assembly and a pitch angle for the trowel blade, and control the motor to drive the blade assembly at the speed setting with the trowel blade at the pitch angle.

In some aspects, the surface sensor includes at least one of an electromagnetic wave/radar sensor, an ultrasonic sensor, and a concrete penetrometer, and the controller is further configured to determine the parameter of the surface based on the output signal from the surface sensor.

Before any embodiments are explained in detail, it is to be understood that the embodiments are not limited in application to the details of the configurations and arrangements of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers," "computing devices," "controllers," "processors," etc., described in the specification can include one or more processing units, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%, 10%, or more) of an indicated value.

It should be understood that although certain drawings illustrate hardware and software located within particular devices, these depictions are for illustrative purposes only. Functionality described herein as being performed by one component may be performed by multiple components in a distributed manner. Likewise, functionality performed by multiple components may be consolidated and performed by a single component. In some embodiments, the illustrated components may be combined or divided into separate software, firmware and/or hardware. For example, instead of being located within and performed by a single electronic processor, logic and processing may be distributed among multiple electronic processors. Regardless of how they are combined or divided, hardware and software components may be located on the same computing device or may be distributed among different computing devices connected by one or more networks or other suitable communication links. Similarly, a component described as performing particular functionality may also perform additional functionality not described herein. For example, a device or structure that is "configured" in a certain way is configured in at least that way but may also be configured in ways that are not explicitly listed.

Other features and aspects will become apparent by consideration of the following detailed description and accompanying drawings.

DETAILED DESCRIPTION

Figure 1:
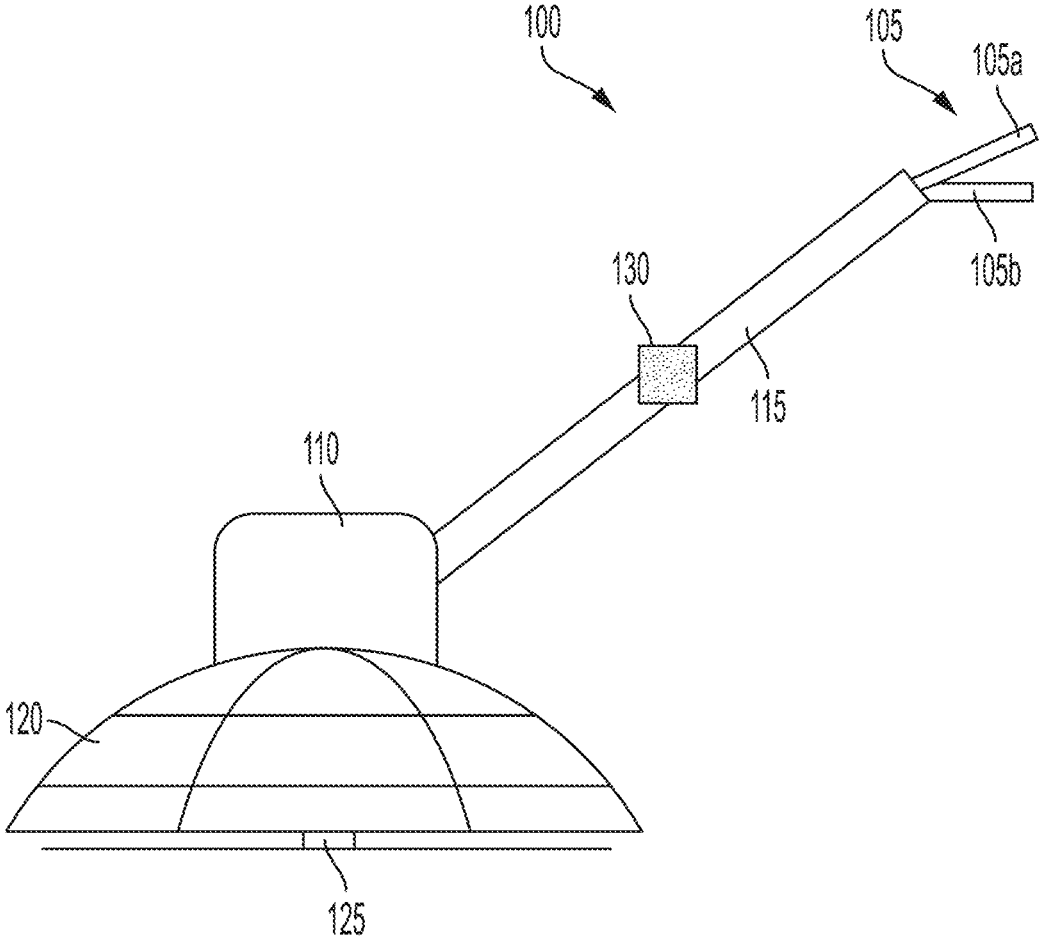
FIG. 1 illustrates a side view of a power trowel in accordance with embodiments described herein.

FIG. 1 illustrates an example of a battery pack powered or power trowel 100, according to some embodiments. The power trowel 100 includes a handle 105, a housing 110 (e.g., a motor housing), a shaft 115, a blade housing (or blade barrier) 120, and a blade assembly 125. The handle 105 is coupled to the housing 110 via the shaft 115. The handle 105 is composed of a first handle (or right handle) 105*a* and a second handle (or left handle) 105*b*. The housing 110 houses a motor 680 (shown in FIG. 6). The motor 680 drives the blade assembly 125. The blade housing 120 surrounds the blade assembly 125 to protect an operator or bystander from movement of the blade assembly 125. In some embodiments, the motor 680 can be used to control blade pitch. In other embodiments, a second motor can be used to control blade pitch.

The motor 680 may receive power from a battery pack 665 (shown in FIG. 6) coupled to the power trowel 100. For example, the battery pack 665 provides direct current (DC) power to the motor 680. However, the power trowel 100 may be configured to be operated by other types of power, such as, but not limited to, alternating-current (AC) power from an AC power source. In some embodiments, the power trowel 100 includes a power cable (e.g., a power cord). In other embodiments, the motor 680 is a gas-powered engine, and other electrical components of the power trowel 100 receive power, directly or indirectly, from AC or DC power generated by the gas-powered engine. Such electrical components may include, for example, kill switches 150, controller 600, indicators 645, load sensor 685, motion sensor 130, secondary sensors 690, and other components illustrated in FIG. 6.

Figure 2:
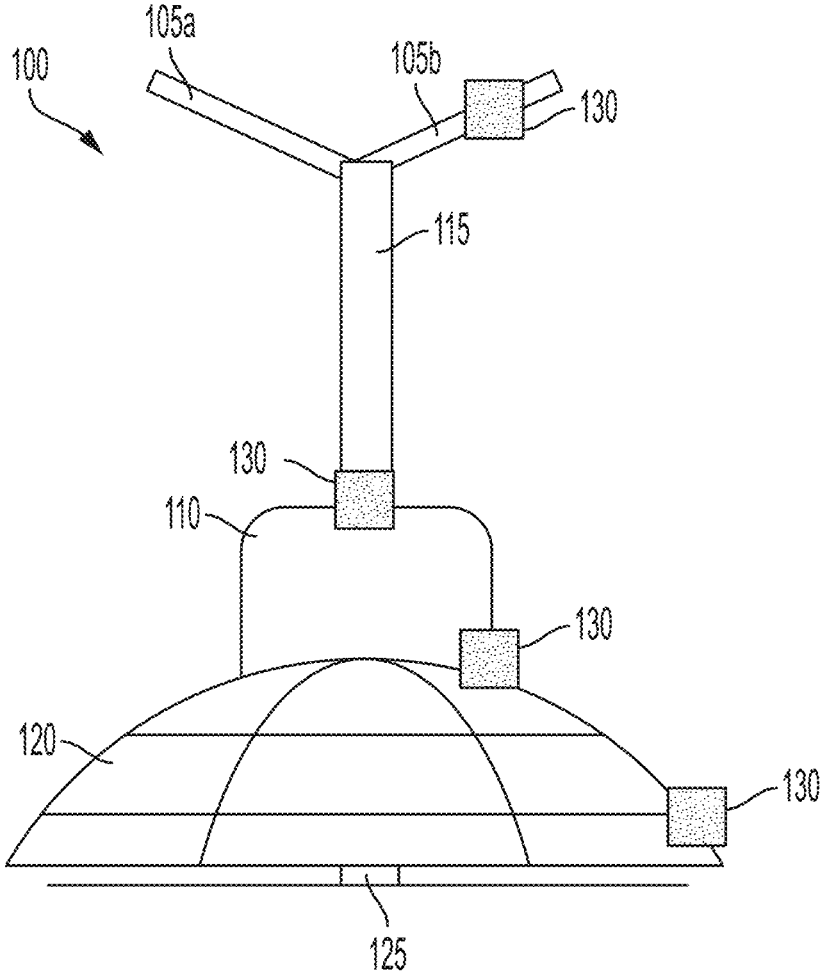
FIG. 2 illustrates a front view of a power trowel in accordance with embodiments described herein.

In some embodiments, the power trowel 100 includes a motion sensor 130 (such as, for example, an accelerometer, a gyroscope, an angle sensor, or the like). The motion sensor 130 outputs signals indicative of detected motion of the power trowel 100. In some embodiments, as illustrated in FIG. 1, the motion sensor 130 is situated or located on the shaft 115. In some embodiments, the motion sensor 130 may be located elsewhere on the power trowel 100. For example, as illustrated in FIG. 2, the power trowel 100 may include a motion sensor 130 situated on the handle 105. The motion sensor 130 may be located on either the first handle 105*a* or the second handle 105*b*. In other embodiments, the power trowel 100 may include a motion sensor 130 situated on the housing 110. The motion sensor 130 may be situated at a location where the shaft 115 couples to the housing 110 or generally on an upper portion of the housing 110. In some embodiments, the power trowel 100 includes a motion sensor 130 situated on a lower portion of the housing 110. For example, the motion sensor 130 may be situated at a location where the housing 110 couples to the blade housing 120. The motion sensor 130 may alternatively be situated on an upper portion of the blade housing 120. In some embodiments, the power trowel 100 includes a motion sensor 130 situated on a lower portion of the blade housing 120. While several locations of the motion sensor 130 are provided, the power trowel 100 may include a number of combinations of the motion sensors 130.

Figure 3:
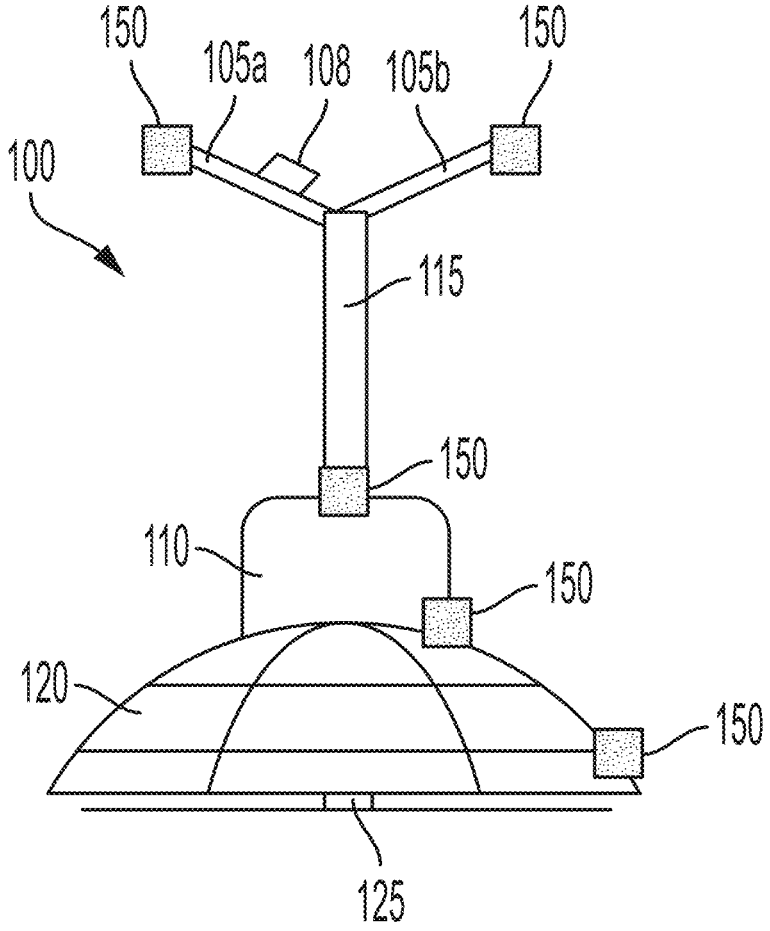
FIG. 3 Illustrates a front view of a power trowel having a kill switch in accordance with embodiments described herein.

In some embodiments, as shown in FIG. 3, the power trowel 100 includes a kill switch 150. The kill switch 150 is configured to shut off or reduce power to the motor 680 in response to being actuated. In some embodiments, the power trowel 100 includes a kill switch 150 situated on the first handle 105*a*. The power trowel 100 may include a kill switch 150 situated on the second handle 105*b*. In some embodiments, as shown in FIG. 3, the power trowel 100 includes a switch or lever (e.g., a trigger) 108 configured to be actuated while the motor 680 is running. For example, an operator holds the lever while operating the power trowel 100. Should the operator release the lever, the motor 680 will shut off.

Figure 4:
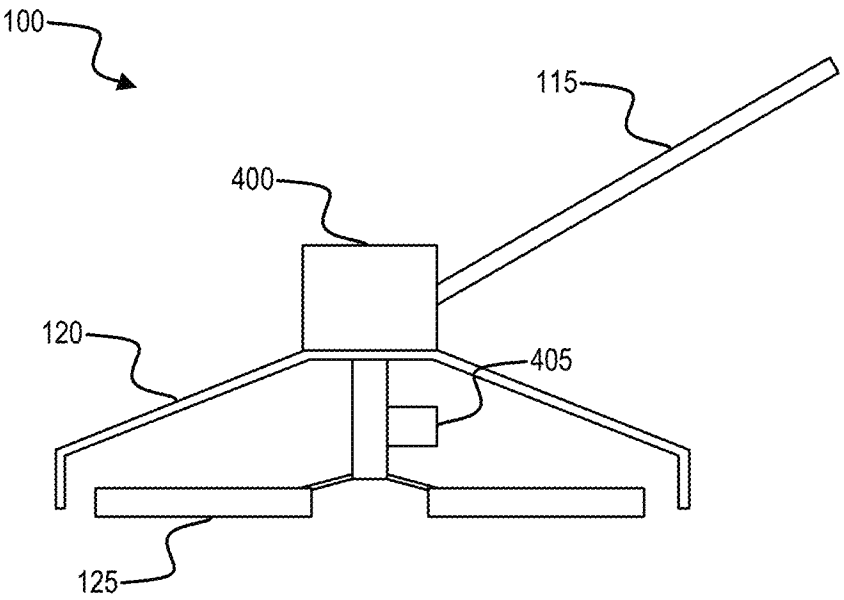
FIG. 4 illustrates a side view of a power trowel in accordance with embodiments described herein.
Figure 5:
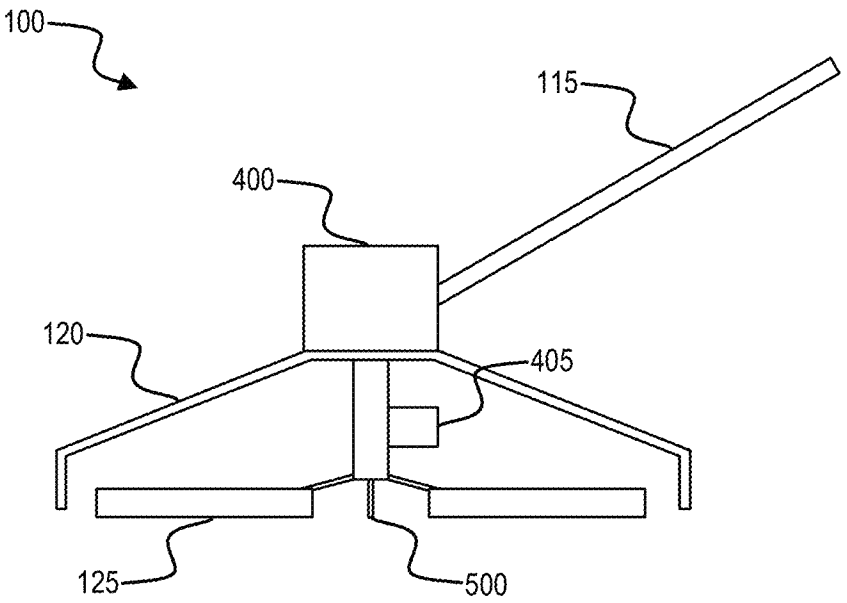
FIG. 5 illustrates a side view of a power trowel in accordance with embodiments described herein.

FIG. 4 illustrates the power trowel 100 including the blade housing 120, the blade assembly 125, a drive unit 400 (e.g., including motor 680), and a pitch control actuator 405. The drive unit 400 is configured to control a rotational speed of the blade assembly 125. The pitch control actuator 405 is configured to control a pitch of the blades in the blade assembly 125. In some embodiments, the rotational speed of the blade assembly 125 and the pitch of the blades in the blade assembly 125 are automatically controlled based on sensor data. FIG. 5 further includes a sensor 500 for detecting one or more conditions or parameters of a surface (e.g., concrete). The sensor 500 includes one or more of the sensors described herein.

Figure 6:
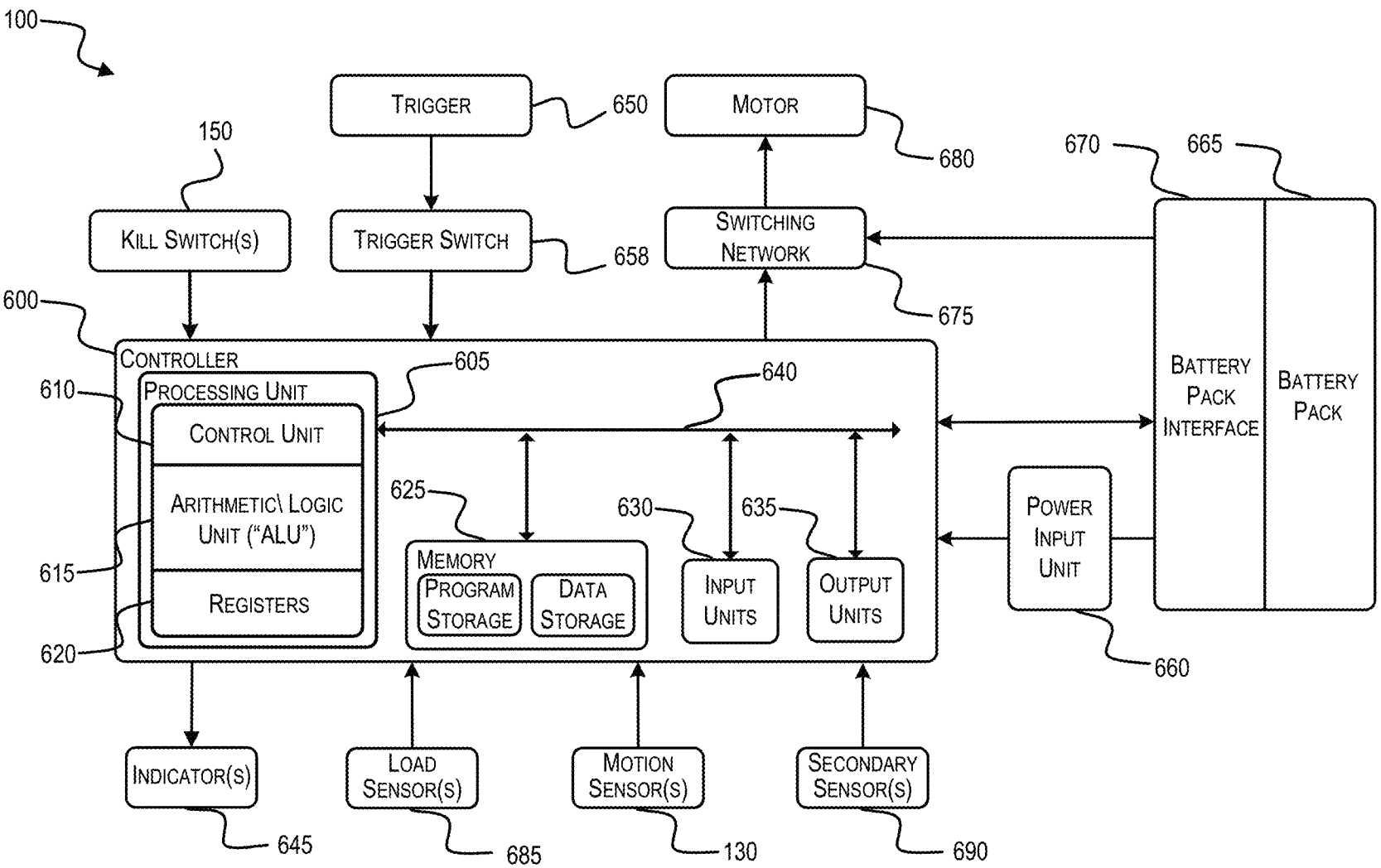
FIG. 6 illustrates a block diagram of a controller for the power trowel of FIGS. 1-5 in accordance with embodiments described herein.

A controller 600 for the power trowel 100 is illustrated in FIG. 6. The controller 600 is electrically and/or communicatively connected to a variety of modules or components of the power trowel 100. For example, the illustrated controller 600 is connected to indicators 645, the motion sensor(s) 130, the kill switch(s) 150, an ON switch or trigger 650 (via a trigger switch 658), the motor 680 (via a power switching network 675), a load sensor 685, secondary sensors 690, and a power input unit 660. The battery pack 665 is connected to a battery pack interface 670 for mechanically and electrically connecting the battery pack 665 to the power trowel 100.

The controller 600 includes a plurality of electrical and electronic components that provide power, operational control, and protection to the components and modules within the controller 600 and/or power trowel 100. For example, the controller 600 includes, among other things, a processing unit 605 (e.g., a microprocessor, an electronic processor, an electronic controller, a microcontroller, or another suitable programmable device), a memory 625, input units 630, and output units 635. The processing unit 605 includes, among other things, a control unit 610, an arithmetic logic unit ("ALU") 615, and a plurality of registers 620 (shown as a group of registers in FIG. 6), and is implemented using a known computer architecture (e.g., a modified Harvard architecture, a von Neumann architecture, etc.). The processing unit 605, the memory 625, the input units 630, and the output units 635, as well as the various modules connected to the controller 600 are connected by one or more control and/or data buses (e.g., common bus 640). The control and/or data buses are shown generally in FIG. 6 for illustrative purposes. The use of one or more control and/or data buses for the interconnection between and communication among the various modules and components would be known to a person skilled in the art in view of the embodiments described herein.

The memory 625 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 605 is connected to the memory 625 and executes software instructions that are capable of being stored in a RAM of the memory 625 (e.g., during execution), a ROM of the memory 625 (e.g., on a generally permanent basis), or another non-transitory computer readable medium such as another memory or a disc. Software included in the implementation of the power trowel 100 can be stored in the memory 625 of the controller 600. The software includes, for example, firmware, one or more applications, program data, filters, rules, one or more program modules, and other executable instructions. The controller 600 is configured to retrieve from the memory 625 and execute, among other things, instructions related to the control processes and methods described herein. In other embodiments, the controller 600 includes additional, fewer, or different components.

The controller 600 drives the motor 680 to rotate the blade assembly 125 in response to a user's actuation of the trigger 650. The blade assembly 125 may be directly coupled to the motor 680 via an output shaft. In other embodiments, the blade assembly 125 is coupled to the motor 680 via a gearbox. Depression of the trigger 650 actuates a trigger switch 658, which outputs a signal to the controller 600 to drive the motor 680, and therefore the blade assembly 125. In some embodiments, the controller 600 drives the power switching network 675 (e.g., a FET switching bridge) to drive the motor 680. For example, the power switching network 675 may include a plurality of high side switching elements (e.g., FETs) and a plurality of low side switching elements. The controller 600 may control each FET of the plurality of high side switching elements and the plurality of low side switching elements to drive each phase of the motor 680. When the trigger 650 is released, the controller 600 may apply a braking force to the motor 680. For example, the power switching network 675 may be controlled to more quickly deaccelerate the motor 680.

The indicators 645 are also connected to the controller 600 and receive control signals from the controller 600 to turn on and off or otherwise convey information based on different states of the power trowel 100. The indicators 645 include, for example, one or more light-emitting diodes (LEDs) or a display screen. The indicators 645 can be configured to display conditions of, or information associated with, the power trowel 100. For example, the indicators 645 can display information relating to the operational state of the power trowel 100 or battery pack 665, such as the charge capacity of the battery pack. The indicators 645 may also display information relating to a fault condition, or other abnormality, of the power trowel 100. In addition to or in place of visual indicators, the indicators 645 may also include a speaker or a tactile feedback mechanism to convey information to a user through audible or tactile outputs. In some embodiments, the indicators 645 display information relating to an uncontrolled condition or state of the power trowel 100 (e.g., a bind-up condition, a kickback condition, etc.). For example, one or more LEDs are activated upon detection of an uncontrolled state of the power trowel 100.

The motion sensor 130 senses motion of the power trowel 100. In some embodiments, the motion sensor 130 provides one or more motion signals (e.g., output signals) indicative of motion of the power trowel 100 to the controller 600. The controller 600 may determine, based on the motion signals, a position of the power trowel 100, such as an orientation of the power trowel 100 or an angle at which the shaft 115 is tilted. In some embodiments, the controller 600 determines an angular displacement, an angular velocity, or an angular acceleration of movement of the power trowel 100 (e.g., with respect to a vertical or z-axis with respect to ground) based on the motion signals.

The load sensor 685 provides load signals to the controller 600 indicative of load conditions of the power trowel 100. The controller 600 may determine, based on the load signals, a current draw of the motor 680, a power draw of the motor 680, a rotations-per-minute (RPM) of the motor 680, an RPM of the blade assembly 125, and the like. Accordingly, the load sensor 685 may include a current sensor, a voltage sensor, Hall effect sensors, speed sensors, etc. Additional sensors, such as voltage sensors, temperature sensors, electromagnetic wave/radar sensors, ultrasonic sensors, cameras (infrared, ultraviolet, etc.), concrete penetrometers, moisture sensors, accelerometers, gyroscopes, global positioning system sensors, laser doppler velocimetry sensors, and the like may be included in the secondary sensors 690 to detect additional conditions of the power trowel 100 or a surface (e.g., concrete).

The kill switch 150 outputs a signal to the controller 600 to stop operation of the motor 680. For example, upon actuation of the kill switch 150, the controller 600 initiates a braking operation of the motor 680 using the power switching network 675. In some embodiments, upon actuation of the kill switch 150, the controller 600 electrically disconnects the battery pack 665 from the power switching network 675, and therefore disconnects the battery pack 665 from the motor 680.

The controller 600 is configured to automatically control a rotational speed of the blade assembly 125 and a pitch of the blades in the blade assembly 125. In some embodiments, the controller 600 uses output sensor signals from the sensors 130, 685, 690 to determine a condition of the concrete upon which the power trowel 100 is operating, and then controls speed and pitch accordingly. For example, the motor speed and motor current for motor 680 are measured. The pitch angle of the blades in the blade assembly, motor torque, motor current, motor speed, etc., can also be determined and used to determine a condition of the concrete.

In other embodiments, the controller is configured to use other sensors 130, 685, 690 to determine a condition of the concrete. For example, voltage sensors, temperature sensors, electromagnetic wave/radar sensors, ultrasonic sensors, cameras (infrared, ultraviolet, etc.), concrete penetrometers, moisture sensors, accelerometers, gyroscopes, global positioning system sensors, laser doppler velocimetry sensors, and the like may be included in the secondary sensors 690 to detect additional conditions of the power trowel 100 or a surface (e.g., concrete), can be used to determine the condition of the concrete. In some embodiments, these sensors are also configured to detect a loss of control of the power trowel 100. In some embodiments, the power trowel includes a time-of-flight sensor array mounted to the protective cage. The sensors would be mounted facing downwards toward the concrete surface to measure a distance between the protective cage and concrete. Using a multitude of time-of-flight sensors would give pose estimation (e.g., three degrees of freedom spatially and three degrees of freedom rotationally) relative to the concrete surface to combine with other sensor data.

Figure 7:
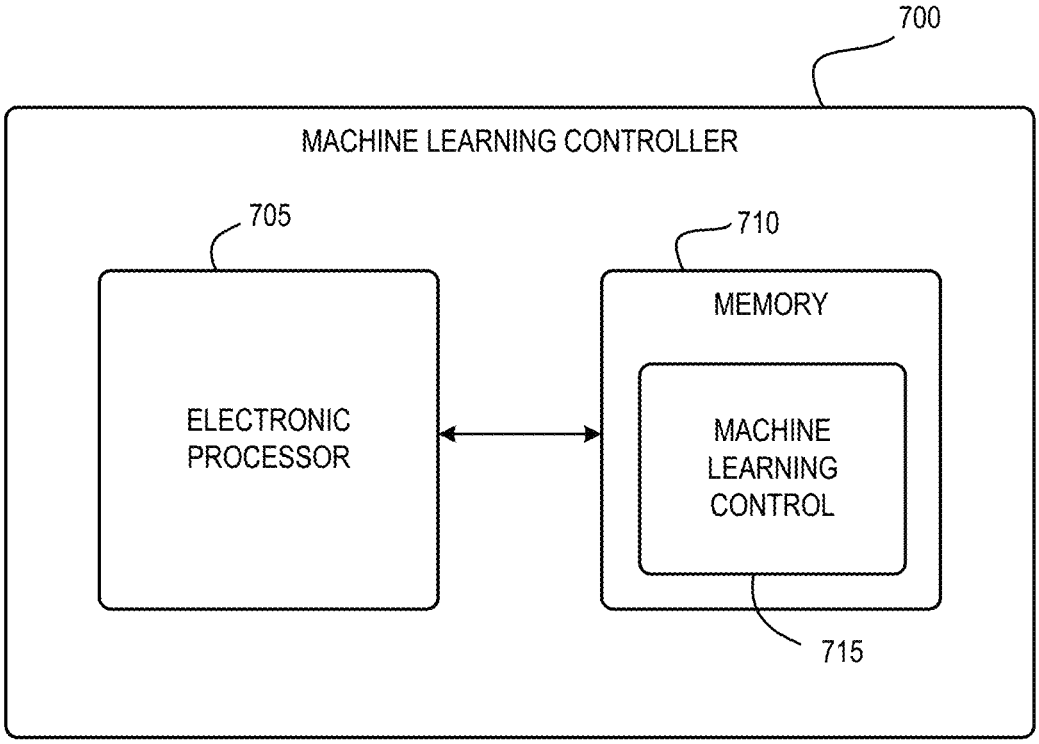
FIG. 7 illustrates a block diagram of a machine learning controller in accordance with embodiments described herein.

In some embodiments, the controller 600 includes a machine learning controller 700. As shown in FIG. 7, the machine learning controller 700 includes a machine learning electronic processor 705 and a machine learning memory 710. The machine learning memory 710 stores a machine learning control 715. The machine learning control 715 may include a trained machine learning program, as described below. In some embodiments, the trained machine learning program is instead stored in the memory 625 of the power trowel 100 and implemented by the processing unit 605. The machine learning control 715 may be built and operated by the power trowel 100 or a remote device (e.g., a server). In other embodiments, the machine learning control 715 is built on and/or implemented by an intermediate external device, such as a phone, tablet, gateway, hub, or other power tool separate from the power trowel 100.

The machine learning controller 700 implements a machine learning program. For example, the machine learning controller 700 is configured to construct a model (e.g., building one or more algorithms) based on example inputs. Supervised learning involves presenting a computer program with example inputs and their actual outputs (e.g., categorizations). The machine learning controller 700 is configured to learn a general rule or model that maps the inputs to the outputs based on the provided example input-output pairs. The machine learning algorithm may be configured to perform machine learning using various types of methods. For example, the machine learning controller 700 may implement the machine learning program using decision tree learning (such as random decision forests), associates rule learning, artificial neural networks, recurrent artificial neural networks, long short term memory neural networks, inductive logic programming, support vector machines, clustering, Bayesian networks, reinforcement learning, representation learning, similarity and metric learning, sparse dictionary learning, genetic algorithms, k-nearest neighbor (KNN), among others, such as those listed in Table 1 below. In some embodiments the machine learning program is implemented by the controller 600, an external device, or a combination of the controller 600, an external device, and/or the machine learning controller 700.

TABLE 1

| | |
|---|---|
| Recurrent Models | Recurrent Neural Networks ["RNNs"], Long Short-Term Memory ["LSTM"] models, Gated Recurrent Unit ["GRU"] models, Markov Processes, Reinforcement learning |
| Non-Recurrent Models | Deep Neural Network ["DNN"], Convolutional Neural Network ["CNN"], Support Vector Machines ["SVM"], Anomaly detection (ex: Principle Component Analysis ["PCA"]), logistic regression, decision trees/forests, ensemble methods (combining models), polynomial/Bayesian/other regressions, Stochastic Gradient |

TABLE 1-continued

| |
|---|
| Descent ["SGD"], Linear Discriminant Analysis ["LDA"], Quadratic Discriminant Analysis ["QDA"], Nearest neighbors classifications/regression, näive Bayes, attention networks, transformer networks, etc. |

The machine learning controller 700 is programmed and trained to perform a particular task. For example, in some embodiments, the machine learning controller 700 is trained to identify an application (or operation) performed by the power trowel 100. The training examples used to train the machine learning controller 700 may be graphs or tables of operating profiles, such as blade speed over time, pitch angle over time, current over time, and the like for a given application. The training examples may be previously collected training examples, from, for example, a plurality of the same type of power trowels. For example, the training examples may have been previously collected from a plurality of power trowels of the same type (e.g., the same size blades) over a span of, for example, one year.

A plurality of different training examples is provided to the machine learning controller 700. The machine learning controller 700 uses these training examples to generate a model (e.g., a rule, a set of equations, and the like) that helps categorize or estimate the output based on new input data. The machine learning controller 700 may weight different training examples differently to, for example, prioritize different conditions or inputs and outputs to and from the machine learning controller 700. For example, certain observed operating characteristics may be weighed more heavily than others, such as blade speed and pitch angle.

In one example, the machine learning controller 700 implements an artificial neural network. The artificial neural network includes an input layer, a plurality of hidden layers or nodes, and an output layer. Typically, the input layer includes as many nodes as inputs provided to the machine learning controller 700. As described above, the number (and the type) of inputs provided to the machine learning controller 700 may vary based on the particular task for the machine learning controller 700. Accordingly, the input layer of the artificial neural network of the machine learning controller 700 may have a different number of nodes based on the particular task for the machine learning controller 700. The input layer connects to the hidden layers. The number of hidden layers varies and may depend on the particular task for the machine learning controller 700. Additionally, each hidden layer may have a different number of nodes and may be connected to the next layer differently. For example, each node of the input layer may be connected to each node of the first hidden layer. The connection between each node of the input layer and each node of the first hidden layer may be assigned a weight parameter. Additionally, each node of the neural network may also be assigned a bias value. However, each node of the first hidden layer may not be connected to each node of the second hidden layer. That is, there may be some nodes of the first hidden layer that are not connected to all of the nodes of the second hidden layer. The connections between the nodes of the first hidden layers and the second hidden layers are each assigned different weight parameters. Each node of the hidden layer is associated with an activation function. The activation function defines how the hidden layer is to process the input received from the input layer or from a previous input layer. These activation functions may vary and be based on not only the type of task associated with the machine learning controller 700, but may also vary based on the specific type of hidden layer implemented.

Each hidden layer may perform a different function. For example, some hidden layers can be convolutional hidden layers which can, in some instances, reduce the dimensionality of the inputs, while other hidden layers can perform statistical functions such as max pooling, which may reduce a group of inputs to the maximum value, an averaging layer, among others. In some of the hidden layers (also referred to as "dense layers"), each node is connected to each node of the next hidden layer. Some neural networks including more than, for example, three hidden layers may be considered deep neural networks. The last hidden layer is connected to the output layer. Similar to the input layer, the output layer typically has the same number of nodes as the possible outputs.

During training, the artificial neural network receives the inputs for a training example and generates an output using the bias for each node, and the connections between each node and the corresponding weights. The artificial neural network then compares the generated output with the actual output of the training example. Based on the generated output and the actual output of the training example, the neural network changes the weights associated with each node connection. In some embodiments, the neural network also changes the weights associated with each node during training. The training continues until a training condition is met. The training condition may correspond to, for example, a predetermined number of training examples being used, a minimum accuracy threshold being reached during training and validation, a predetermined number of validation iterations being completed, and the like. Different types of training algorithms can be used to adjust the bias values and the weights of the node connection based on the training examples. The training algorithms may include, for example, gradient descent, newton's method, conjugate gradient, quasi newton, and levenberg marquardt, among others.

In another example, the machine learning controller 700 implements a support vector machine to perform classification. The machine learning controller 700 may receive inputs from the sensors 130, 685, 690. The machine learning controller 700 then defines a margin using combinations of some of the input variables as support vectors to maximize the margin. In some embodiments, the machine learning controller 700 defines a margin using combinations of more than one of similar input variables. The margin corresponds to the distance between the two closest vectors that are classified differently. In other embodiments, a single support vector machine can use more than two input variables and define a hyperplane that separates the types of applications.

The training examples for a support vector machine include an input vector including values for the input variables (e.g., blade speed, motor voltage, motor current, motor speed, pitch angle, and the like), and an output classification indicating the application performed by the power trowel 100. During training, the support vector machine selects the support vectors (e.g., a subset of the input vectors) that maximize the margin. In some embodiments, the support vector machine may be able to define a line or hyperplane that accurately separates the types of applications. In other embodiments (e.g., in a non-separable case), however, the support vector machine may define a line or hyperplane that maximizes the margin and minimizes the slack variables, which measure the error in a classification of a support vector machine. After the support vector machine has been trained, new input data can be compared to the line or hyperplane to determine how to classify the new input data. In other embodiments, as mentioned above, the machine learning controller 700 can implement different machine learning algorithms to make an estimation or classification based on a set of input data. For example, a random forest classifier may be used, in which multiple decision trees are implemented to observe different operational features of the power trowel 100. Each decision tree has its own output, and majority voting may be used to determine the final output of the machine learning controller 700.

To train the machine learning control 715, the machine learning controller 700 may be provided with a plurality of application profiles. The plurality of application profiles related to various combinations of input parameters, such as blade speed, pitch angle, etc. The application profiles can also correspond to tables of values or other sets of numerical values that represent the application profiles. Each application profile provides, for example, a rotational speed of the blade assembly, a pitch angle, etc. Additionally each application profile may be labelled such that the machine learning controller 700 can learn the expected profile for each application.

In embodiments where the machine learning program is implemented by the controller 600 (e.g., locally on the power trowel 100), the machine learning control 715 may require firmware or memory updates. Accordingly, a prompt asking a user to update the machine learning program may be provided via the indicators 645 or on a display of an external device.

Because speed and pitch are currently set by user feel, the machine learning controller 700 could be used to help determine the proper settings for the power trowel 100 based on combinations of any of the sensors/parameters described herein. A machine learning model can be built as described above by collecting training data that would include measured values from any available sensors, user selected speed and pitch settings, etc. The training data would then be used to build a model to predict the speed and pitch settings based on input sensor values. The model could also continue to learn and improve over time by giving the user the ability to manually adjust the speed while in use. This could be useful in helping the power trowel to adapt to specific user preferences. This would work by starting with a model built from a collected set of training data. The power trowel 100 would use that model to set the initial speed and pitch based on input sensor data. A user could then manually adjust the speed and pitch as desired. These adjustments would be recorded by the controller 600 or machine learning controller 700, and then be used to adjust the model for future use. The machine learning controller 700 could also be used to predict loss of control of the power trowel to disable operation of the device when a loss of control is detected (e.g., kickback). The same sensor set and machine learning algorithms used in the speed and pitch control could be used for loss of control detection.

Figure 8:
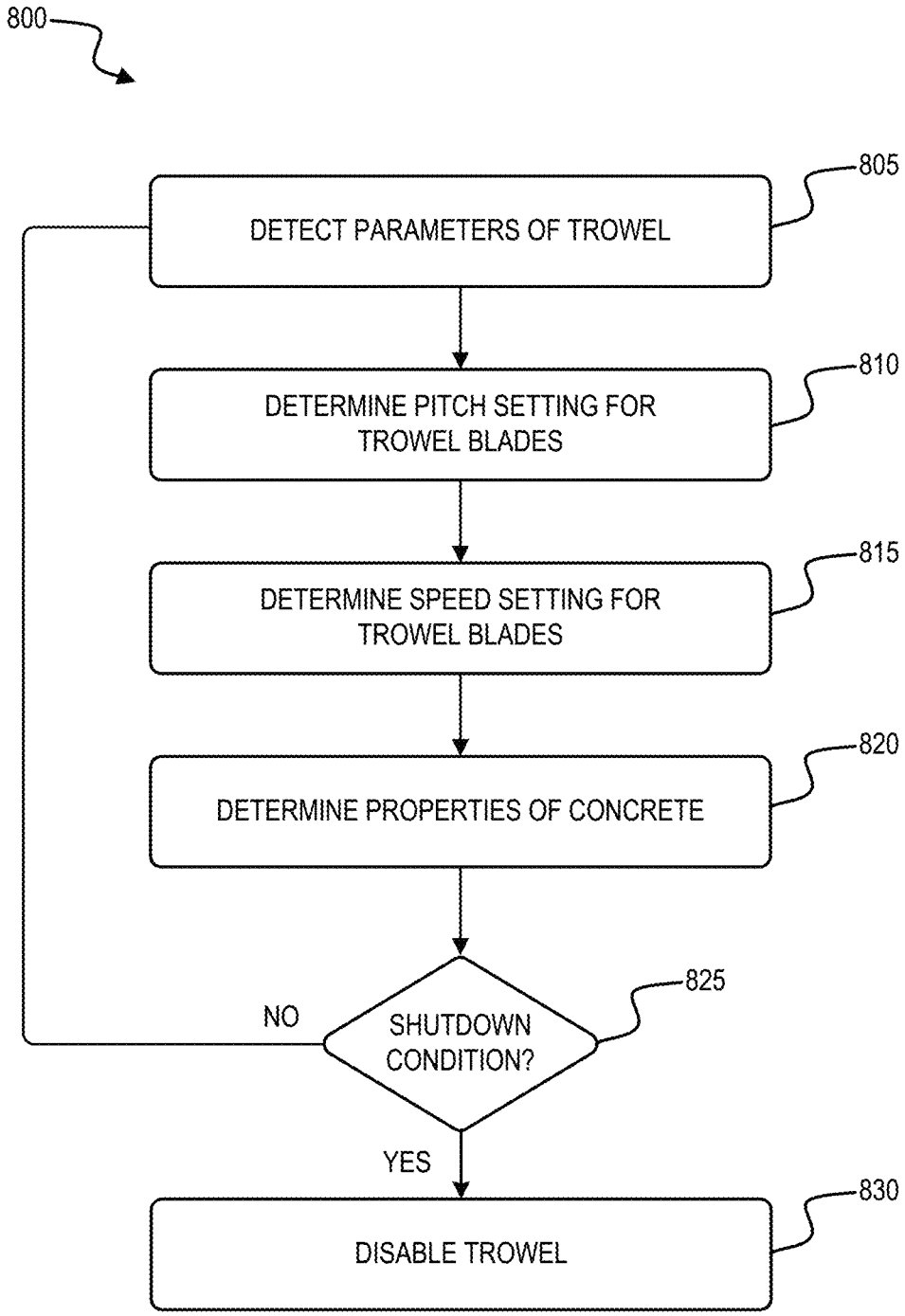
FIG. 8 illustrates a block diagram of a method of controlling the trowel of FIGS. 1-5 in accordance with embodiments described herein.

FIG. 8 is process 800 for controlling operation of the power trowel 100. The controller 600 (and/or machine learning controller 700) detect parameters of the power trowel 100 using any of the sensors disclosed herein (STEP 805). The controller 600 then determines appropriate or ideal pitch settings for the blades in the blade assembly 125 (STEP 810). The controller 600 then determines appropriate or ideal speed settings for the trowel blades (STEP 815). The controller 600 (or machine learning controller 700) can also determine properties or characteristics of the concrete upon which the power trowel 100 is operating (STEP 820). If, based on the properties of the concrete, the controller 600 or machine learning controller 700 detects a shutdown condition (STEP 825), the power trowel 100 is disabled.

Thus, embodiments provided herein describe, among other things, systems and methods for determining and reacting to a kickback event or an otherwise uncontrolled state of a power trowel. Various features and advantages are set forth in the following claims.

What is claimed is:

1. A power trowel comprising:
- a handle;
- a housing;
- a blade assembly including a trowel blade;
- a motor coupled to the blade assembly;
- a plurality of sensors configured to generate output signals related to an operational state of the power trowel;
- a controller connected to the motor and the plurality of sensors, the controller configured to:
  - receive the output signals from the plurality of sensors,
  - determine, based on the output signals, a speed setting for the blade assembly and a pitch angle for the trowel blade, and
  - control the motor to drive the blade assembly at the speed setting with the trowel blade at the pitch angle.

2. The power trowel of claim 1, wherein the plurality of sensors include a load sensor configured to provide a load signal indicative of a load condition of the motor.

3. The power trowel of claim 2, wherein the controller is further configured to:
- monitor the load condition of the motor; and
- adjust at least one of the speed setting and the pitch angle based on the load condition of the motor.

4. The power trowel of claim 3, wherein the load condition is at least one selected from a group consisting of: a current draw of the motor, a power draw of the motor, a rotations-per-minute ("RPM") of the motor, and an RPM of the blade assembly.

5. The power trowel of claim 1, wherein the plurality of sensors include a motion sensor configured to provide a motion signal indicative of a motion of the power trowel.

6. The power trowel of claim 5, wherein the controller is further configured to:
- monitor the motion of the power trowel; and
- adjust at least one of the speed setting and the pitch angle based on the motion of the power trowel.

7. The power trowel of claim 1, further comprising:
- a machine learning controller configured to:
  - determine, based on the output signals, the speed setting for the blade assembly and the pitch angle for the trowel blade.

8. The power trowel of claim 1, wherein:
- the plurality of sensors include at least one of an electromagnetic wave/radar sensor, an ultrasonic sensor, and concrete penetrometer; and
- the controller is further configured to:
  - determine a parameter of a surface based on the output signals from the plurality of sensors.

9. A method of controlling a power trowel, the method comprising:
- receiving, from a plurality of sensors, output signals related to an operational state of the power trowel;
- determining, using an electronic controller, a speed setting for a blade assembly and a pitch angle for a trowel blade based on the output signals related to the operational state of the power trowel; and
- controlling a motor to drive the blade assembly at the speed setting with the trowel blade at the pitch angle.

10. The method of claim 9, wherein the plurality of sensors include a load sensor providing a load signal indicative of a load condition of the motor.

11. The method of claim 10, further comprising:

monitoring the load condition of the motor; and adjusting at least one of the speed setting and the pitch angle based on the load condition of the motor.

12. The method of claim 11, wherein the load condition is at least one selected from a group consisting of: a current draw of the motor, a power draw of the motor, a rotations-per-minute ("RPM") of the motor, and an RPM of the blade assembly.

13. The method of claim 9, wherein the plurality of sensors include a motion sensor providing a motion signal indicative of a motion of the power trowel.

14. The method of claim 13, further comprising:

monitoring the motion of the power trowel; and adjusting at least one of the speed setting and the pitch angle based on the motion of the power trowel.

15. The method of claim 9, further comprising:

determining, using a machine learning controller and based on the output signals, the speed setting for the blade assembly and the pitch angle for the trowel blade.

16. The method of claim 9, wherein the plurality of sensors include at least one of an electromagnetic wave/radar sensor, an ultrasonic sensor, and concrete penetrometer; and the method further comprises:

determining a parameter of a surface based on the output signals from the plurality of sensors.

* * * * *